US006853817B2

(12) United States Patent
Suzuki

(10) Patent No.: US 6,853,817 B2
(45) Date of Patent: Feb. 8, 2005

(54) METHOD FOR CORRECTING AND CONTROLLING IMAGE FORMING CONDITIONS

(75) Inventor: Kazuo Suzuki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 96 days.

(21) Appl. No.: 10/231,299

(22) Filed: Aug. 30, 2002

(65) Prior Publication Data

US 2003/0049039 A1 Mar. 13, 2003

(30) Foreign Application Priority Data

| | | |
|---|---|---|
| Aug. 31, 2001 | (JP) | 2001-264825 |
| Sep. 20, 2001 | (JP) | 2001-287760 |
| Jan. 7, 2002 | (JP) | 2002-000893 |
| Jan. 18, 2002 | (JP) | 2002-010645 |

(51) Int. Cl.[7] ..... G03G 15/00
(52) U.S. Cl. ..... 399/49
(58) Field of Search ..... 399/49, 53, 74

(56) References Cited

U.S. PATENT DOCUMENTS

| | | | | |
|---|---|---|---|---|
| 5,991,558 A | * | 11/1999 | Emi et al. | 399/49 |
| 6,215,968 B1 | * | 4/2001 | Uehara et al. | 399/49 |
| 6,456,803 B2 | | 9/2002 | Suzuki et al. | 399/49 |
| 6,597,878 B2 | * | 7/2003 | Nakazato et al. | 399/49 |
| 6,633,734 B2 | * | 10/2003 | Maebashi et al. | 399/49 |
| 6,658,221 B2 | * | 12/2003 | Hama et al. | 399/49 |

FOREIGN PATENT DOCUMENTS

| | | | | |
|---|---|---|---|---|
| JP | 10-221902 | * | 8/1998 | G03G/15/00 |
| JP | 2000-029271 | * | 1/2000 | G03G/15/01 |

* cited by examiner

*Primary Examiner*—Robert Beatty
(74) *Attorney, Agent, or Firm*—Fitzpatrick, Cella, Harper & Scinto

(57) ABSTRACT

A correction method of a control mechanism optimizing a corrected output and controlling image forming conditions of an image forming apparatus. The control mechanism includes an image forming unit for forming a toner image, a light emitting element for emitting light toward a predetermined toner image formed by the image forming unit, a first light receiving element for receiving regular reflection light caused by a light emission of the light emitting element, and a second light receiving element for receiving diffuse reflection light caused by the light emission of the light emitting element. The control mechanism controls an image forming condition of the image forming unit on the basis of a corrected output. The correction method controlling the control mechanism includes forming a correction toner image by the image forming unit, detecting, by the first and second light receiving elements, the diffuse reflection light caused when the light emitting element emits light toward the correction toner image, and correcting the corrected output on the basis of outputs of the first and second light receiving elements obtained in the detecting step.

6 Claims, 19 Drawing Sheets

METHOD FOR CORRECTING AND CONTROLLING IMAGE FORMING CONDITIONS

BACKGROUND OF THE INVENTION

1. Field of the Invention

The present invention relates to a control method used in an image forming apparatus that employs an electrophotographic process, an electrostatic recording process or the like and to an image forming apparatus using the control method. The present invention is applicable to image forming apparatuses such as a copying machine, a printer and a facsimile machine.

2. Related Background Art

Conventionally, there has been proposed an image forming apparatus that repeats a process of transferring a toner image, which is formed on a photosensitive drum using developer consisting of carrier and toner, to paper attracted and borne on a transfer drum, thereby forming a full color image on the paper.

In such an image forming apparatus, a weight ratio of toner and carrier contained in a developing device changes by repeated development operations and supply of toner to the developing device. In order to grasp the change, a density detecting mechanism for detecting information corresponding to a weight ratio of toner and carrier is provided in the image forming apparatus.

For example, a patch sensor is provided in a position opposed to a transfer sheet constituting the transfer drum, and a density of a patch-shaped developed image for density detection (patch) transferred onto the transfer sheet is detected by this sensor.

In addition, a weight ratio of toner and carrier in the developing device, that is, a supplied toner amount is controlled such that a detected density of a patch image is maintained constant.

Such a method of forming a patch image on the transfer drum and a density detecting mechanism for a patch image will be further described.

In the image forming apparatus, a reference image generating circuit having a signal level corresponding to a predetermined density is provided as one of image control means. In a patch image forming process, a laser beam is emitted according to a reference image signal from the reference image generating circuit to scan a surface of the photosensitive drum. Consequently, an electrostatic latent image for density detection (reference electrostatic latent image) corresponding to the predetermined density is formed on the photosensitive drum. This reference electrostatic latent image is developed by the developing device, whereby a patch image is formed. Thereafter, this patch image is transferred to the transfer sheet by a transfer charger.

In addition, conventionally, there has been proposed a patch sensor 13 as shown in FIG. 1 as a sensor for detecting a density of such a patch image. The patch sensor 13 uses a near infrared LED and a photodiode (PD) as a light emitting element and a light receiving element, respectively, to detect a density from a regular reflection light amount and a diffuse reflection light amount that are obtained from a developed image (toner image) 200 visualized on a transfer sheet 5*f*. A method for the detection will be described below.

The patch sensor 13 is constituted by PDs 13*e*, 13*f* and 13*g* and prisms 13*h* and 13*i*. Light irradiated by an LED 13*c* is split into a component vibrating in a vertical direction with respect to an incident surface (s-wave light) and a component vibrating in a parallel direction with respect to the incident surface (p-wave light).

The s-wave light is irradiated on the PD 13*e* in the vicinity of the LED 13*c* and the p-wave light is irradiated on a toner surface. The p-wave light, which is incident on a surface to be a background such as transfer sheet in detecting a density, is generally reflected regularly and is transmitted through the prism 13*i* to be incident on the PD 13*f* with regular reflection light as a p-wave. The p-wave light irradiated on the toner surface, which is a patch image, is diffusely reflected and split into a p-wave and an s-wave with a part of the p-wave light turning into the s-wave. Transmitted through the prism 13*i*, the p-wave is incident on the PD 13*f* and detected as regular reflection light, and the s-wave is incident on the PD 13*g* and detected as diffuse reflection light. Thus, the PD 13*f* functions as regular reflection light amount detecting means and the PD 13*g* functions as diffuse reflection light amount detecting means.

Here, outputs of each of the p-wave by the PD 13*f* and the s-wave by the PD 13*g* with respect to patch image densities are shown in FIG. 21A. According to FIG. 21A, a diffuse reflection component is considered to be actually incident on the PD 13*f* as well. Thus, a real regular reflection output as shown in FIG. 21B is obtained by deducting the output of the s-wave by the PD 13*g* multiplied by a certain correction coefficient from the output of the p-wave by the PD 13*f*, that is, from the following expression. The correction coefficient is a predetermined fixed value.

Corrected output="Regular reflection light amount (p-wave) output"−"Diffuse reflection light amount (s-wave) output"×Correction coefficient A corrected output obtained in this way is converted according to a graph of FIG. 21B and detected as a patch image density. Based on this result of patch image density detection, a weight ratio of toner and carrier (toner supply amount) and operating conditions (applied bias, etc.) of a charger taking part in image formation, a developing device and a transfer charger, that is, image forming conditions are controlled such that an image is formed with an accurate density.

However, in the patch sensor 13 and a method of using the same, outputs from the respective patch sensors 13 may vary due to an individual difference of the patch sensor 13 or attachment accuracy or the like in attaching the patch sensors 13 to the image forming apparatus despite the fact that densities of formed patch images are the same.

As a result of inspection of causes of this variation, it was found by the inventor that, if there are problems in the individual difference of the patch sensor 13 or the attachment accuracy in attaching the patch sensors 13 to the image forming apparatus, since, for example, outputs of the two PDs 13*f* and 13*g* in sensing a predetermined reference plate changes and an output ratio of the two PDs 13*f* and 13*g* changes accordingly, the above-described corrected output changes.

SUMMARY OF THE INVENTION

The present invention has been devised in view of the above and other drawbacks of the conventional art, and it is an object of the present invention to provide a control method, which is capable of optimizing a corrected output and controlling image forming conditions satisfactorily even if an individual difference of a detection sensor and variation in attaching the detection sensor to an image forming apparatus occur, and an image forming apparatus using the control method.

DESCRIPTION OF THE PREFERRED EMBODIMENTS

An image forming apparatus in accordance with the present invention and an image density controlling mechanism, which is a characteristic part of the image forming apparatus, will be described in detail with reference to the accompanying drawings.

First Embodiment

Figure 2:
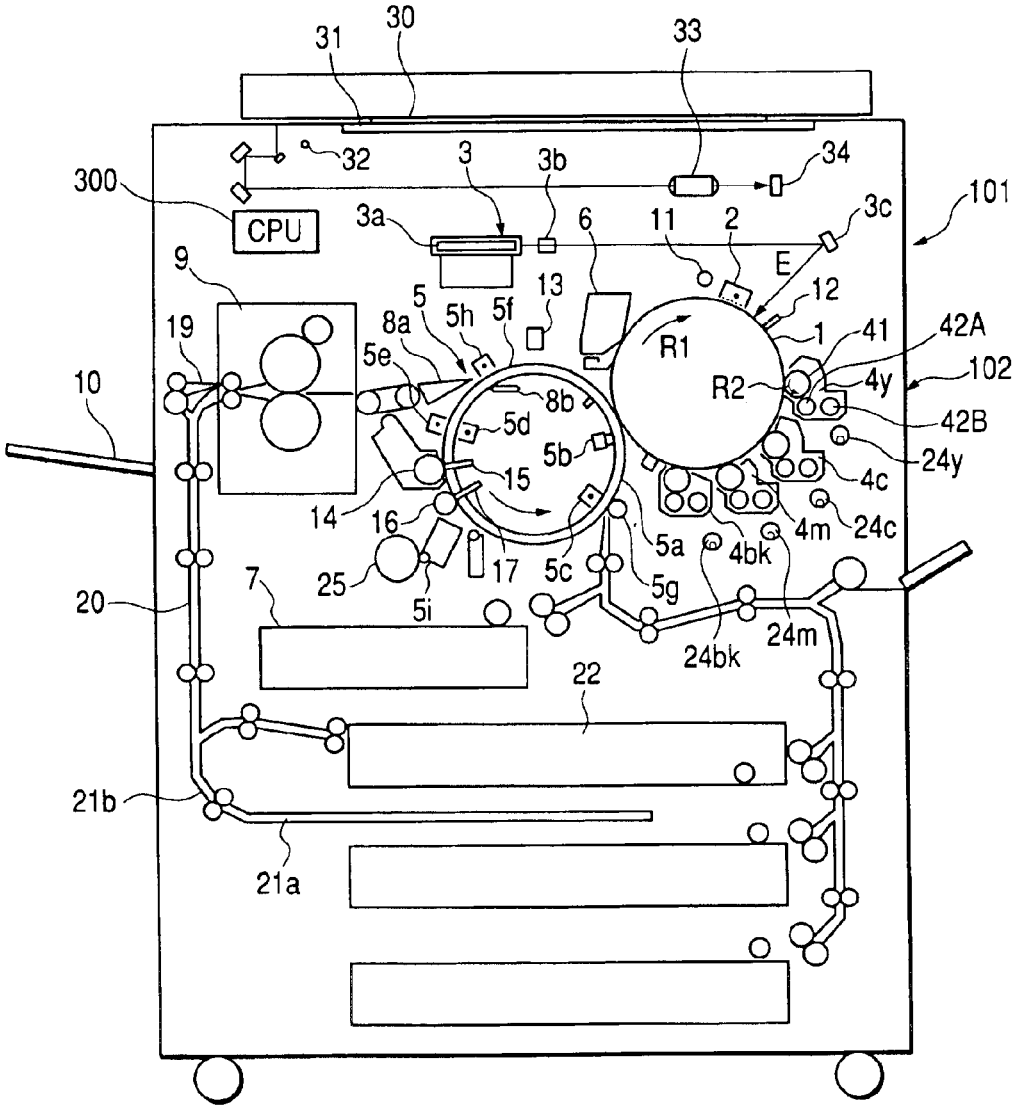
FIG. 2 is a schematic diagram showing an image forming apparatus in accordance with the present invention.

First, an image forming apparatus to which the present invention can be applied will be described. FIG. 2 is a schematic diagram of an example of a color image forming apparatus. The color image forming apparatus of this example has a digital color image reader portion 101 in its upper part and has a digital color image printer portion 102 in its lower part.

In the reader portion 101, an original 30 is placed on an original glass stand 31, and reflected light images from the original 30 subjected to exposure scanning by an exposure lamp 32 are condensed in a full color sensor 34 by a lens 33 to obtain a color separation image signal. The color separation image signal is processed by a video processing portion (not shown) through an amplifier circuit (not shown) and sent to the printer portion 102.

In the printer portion 102, a photosensitive drum 1 functioning as an image bearing member is held to be rotated in a direction indicated by the arrow R1. A pre-exposure lamp 11 functioning as image forming means involved in image formation, a corona charger 2 functioning as charging means, a laser beam exposure optical system 3 functioning as exposing means, an electro static voltmeter 12, four developing devices 4*y*, 4*c*, 4*m* and 4*bk* functioning as developing means, a transfer device 5 functioning as transferring means, and a cleaning device 6 functioning as cleaning means are arranged around the photosensitive drum 1.

The laser beam exposure optical system 3 inputs an image signal from the reader portion 101 and converts the image signal into a light signal by a laser output portion (not shown). Thereafter, the laser beam exposure optical system 3 reflects a laser beam by a polygon mirror 3*a* to make the laser beam pass through a lens 3*b* and a mirror 3*c* and converts the laser beam into a light image E that scans the surface of the photosensitive drum 1 linearly (raster scanning).

When an image is formed in the printer portion 102, first, the photosensitive drum 1 is rotated in the direction indicated by the arrow R1 and charges are eliminated therefrom by the pre-exposure lamp 11. Thereafter, the photosensitive drum 1 is uniformly charged by the corona charger 2 functioning as a primary charger, and the light image E is irradiated for each separated color to form a latent image thereon.

Next, a predetermined developing device 4 (4*y*, 4*c*, 4*m* or 4*bk*) is operated for each separated color to develop the latent image on the photosensitive drum 1 and to form thereon an image (toner image) by developer (toner) having resin as a base. The developing device 4 is arranged to approach the photosensitive drum 1 selectively according to each separated color by an operation of each of eccentric cams 24*y*, 24*c*, 24*m* and 24*bk*.

Moreover, the toner image on the photosensitive drum 1 is transferred to a recording material that is supplied from a recording material cassette 7 to a position opposed to the photosensitive drum 1 via a transporting system and the transfer device 5. The transfer device 5 has in the embodiment, a transfer drum 5*a* functioning as a recording material bearing member, a transfer charger 5*b*, an attractive charger 5*c* for electrostatically attracting a recording material, an attractive roller 5*g* opposed to the attractive charger 5*c*, an inner charger 5*d* and an outer charger 5*e*. A transfer sheet 5*f* functioning as a recording material bearing sheet made of a dielectric is integrally stretched in a cylindrical shape in a circumferential surface opening area of the transfer drum 5*a* that is supported so as to be driven to rotate. The transfer sheet 5*f* uses a dielectric sheet such as a polycarbonate film.

As the transfer drum 5*a* is rotated, the toner image on the photosensitive drum 1 is transferred to a recording material borne on the transfer sheet 5*f* by the transfer charger 5*b*. In this way, a desired number of color images are repeatedly transferred to the recording material, which is attracted on the transfer sheet 5*f* and transported, and a color image is formed thereon.

In the case of a full color mode of four colors, when transfer of developer images (toner images) of four colors is completed in this way, the recording material is separated from the transfer drum 5*a* by actions of a separation claw 8*a*, a separation upthrust runner 8*b* and a separation charger 5*h* and is delivered to a tray 10 via a heat roller fixing device 9.

On the other hand, the photosensitive drum 1 after the transfer is served for an image forming process again after residual toner on its surface is cleaned by the cleaning device 6.

If images are formed on both sides of the recording material, a transporting path switching guide 19 is driven immediately after delivering the recording material from the fixing device 9 to guide the recording material to an inverter path 21*a* through a delivery vertical path 20. Thereafter, the recording material is once stopped and caused to exit in a direction, that is opposite to a direction of entering the recording material, with a trailing end in entering the recording material as a leading end, by reverse rotation of an inverter roller 21*b*. Then, the recording material is turned over and stored in an intermediate tray 22. Thereafter, an image is formed on the other side by conducting the above-described image forming process again.

In addition, the surface of the transfer sheet 5*f* on the transfer drum 5*a* is contaminated by scattering and deposition of powder from the photosensitive drum 1, the developing devices 4*y*, 4*m*, 4*c* and 4*bk*, the cleaning device 6 and the like, deposition of toner at the time of jamming (paper jamming) of a recording material, possible deposition of oil on a recording material at the time of two-side image formation, or the like. However, the transfer sheet 5*f* is cleaned by actions of a fur brush 14 and a backup brush 15 opposed to the fur brush 14 via the transfer sheet 5*f* or an oil removing roller 16 and a backup brush 17 opposed to the oil removing roller 16 via the transfer sheet 5*f*. Thereafter, the transfer sheet 5*f* is served for an image forming process again. Such cleaning is performed at the time of forward rotation and at the time of reverse rotation and is performed whenever necessary at the time when jam occurs.

In addition, in this embodiment, a transfer drum eccentric cam 25 is operated to actuate a cam follower 5*i* formed integrally with the transfer drum 5*f*, whereby a gap between the transfer drum 5*a* and the photosensitive drum 1 can be set at predetermined timing and at a predetermined interval. For example, during standby or at the time of power supply OFF, it is possible to space apart the transfer drum 5*a* and the photosensitive drum 1 to make rotation of the transfer drum 5*a* independent of rotation of the photosensitive drum 1.

Further, each developing device 4 (since the developing devices 4*y*, 4*m*, 4*c* and 4*bk* have the same structure, these are collectively referred to as the developing device 4) is provided with first and second agitating and conveying means 42A and 42B. The first and second agitating and conveying means 42A and 42B are constituted so as to convey two-component developer consisting of toner and carrier in opposite directions, respectively. In addition, a developing sleeve 41 functioning as a developer bearing member is arranged above the first agitating and conveying means 42A.

In the above-mentioned series of image forming operations, the developing device 4 operates as described below. When an electrostatic latent image reaches a development position, a developing bias in which an AC voltage is superimposed on a DC voltage is applied from a developing bias power supply (not shown) to the developing sleeve 41. Then, the developing sleeve 41 rotates in a direction indicated by the arrow R2 by a driving device (not shown) for the developing sleeve 41, and the developing device 4 is pressurized toward the photosensitive drum 1 by the developing and pressurizing cam 24 (24*y*, 24*m*, 24*c* and 24*bk*) to visualize the electrostatic latent image.

Moreover, a weight ratio of toner and carrier contained in the developing device 4 changes by repeated developing operations or toner supply to the developing device 4. Thus, in order to grasp the change, a density detecting mechanism for detecting information corresponding to a weight ratio of toner and carrier is provided in the image forming apparatus. The patch sensor 13 functioning as density detecting means is provided in a position on the transfer sheet 5*f* on the surface of the transfer drum 5*a* and between the photosensitive drum 1 and the separation charger 5*h* in the rotating direction of the transfer drum 5*a*. The patch sensor 13 detects a density of a developed image (patch) for density detection of a patch shape transferred to a non-image area on the transfer sheet 5*f* stuck to the transfer drum 5*a*.

Then, the patch sensor 13 controls a weight ratio of toner and carrier in the developing device 4, that is, a toner supply amount by a CPU 300 such that the detected density of a patch image is maintained constant.

In addition, as another role of the patch sensor 13, the patch sensor 13 executes adjustment and control of operating conditions of a primary charger, an exposure device, a developing device and a transfer charger, that is, adjustment and control of a primary charging bias, an exposure light amount, a developing bias and a transfer bias by the CPU 300 based on a detection result of a density of a patch image (such that the density of the patch image becomes a desired value).

That is, in the present invention, image forming conditions by image forming means (a primary charger, an exposure device, a developing device, and a transfer charger) mean executing at least one of control of a toner supply amount to the developing device and adjustment and control of a primary charging bias, an exposure light amount, a developing bias and a transfer bias.

Next, such a method of forming a patch image and a detecting mechanism of a density of a patch image will be described in detail.

In addition, in the image forming apparatus, a reference image generating circuit having a signal level corresponding to a predetermined density is provided as the image controlling means 300. In an image forming process, a laser beam is emitted according to a reference image signal from this reference image generating circuit to scan the photosensitive drum 1. Consequently, an electrostatic latent image for density detection (reference electrostatic latent image) corresponding to the predetermined density is formed on the photosensitive drum 1. This reference electrostatic latent image is developed by the developing device 4, whereby a patch image is formed. Thereafter, this patch image is transferred to the transfer sheet 5*f* that is a non-image area on the transfer drum 5*a* by the transfer charger 5*b*.

Figure 1:
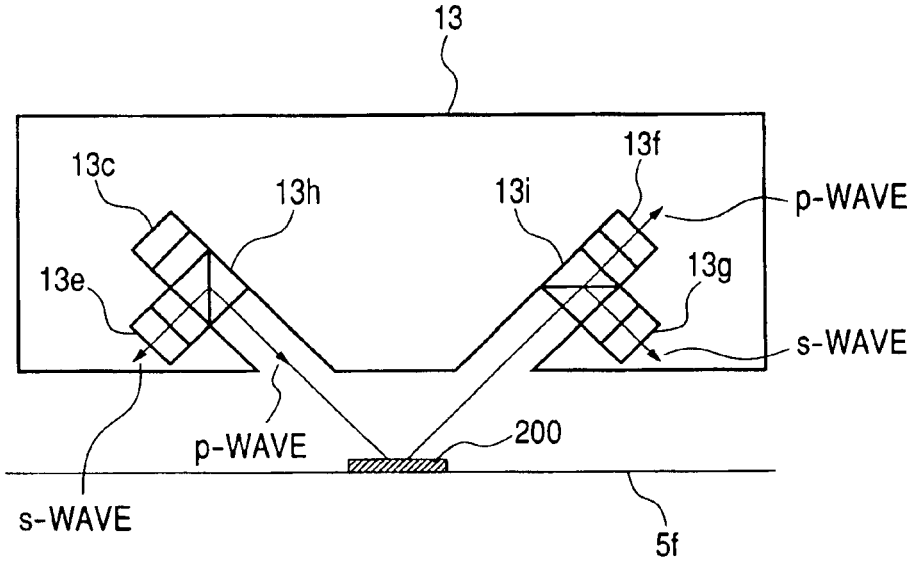
FIG. 1 is a schematic diagram showing density detecting means in accordance with the present invention.

In addition, in the present invention, the patch sensor described in the section of the related background art can be used. The patch sensor 13, whose schematic structure is shown in FIG. 1, uses a near infrared LED as a light emitting element and a photodiode (PD) as a light receiving element to detect a density from a regular reflection light amount and a diffuse reflection light amount that are obtained from a developed image (toner image) 200 visualized on the transfer sheet 5*f*. A method for the detection will be described below again.

Figure 18:
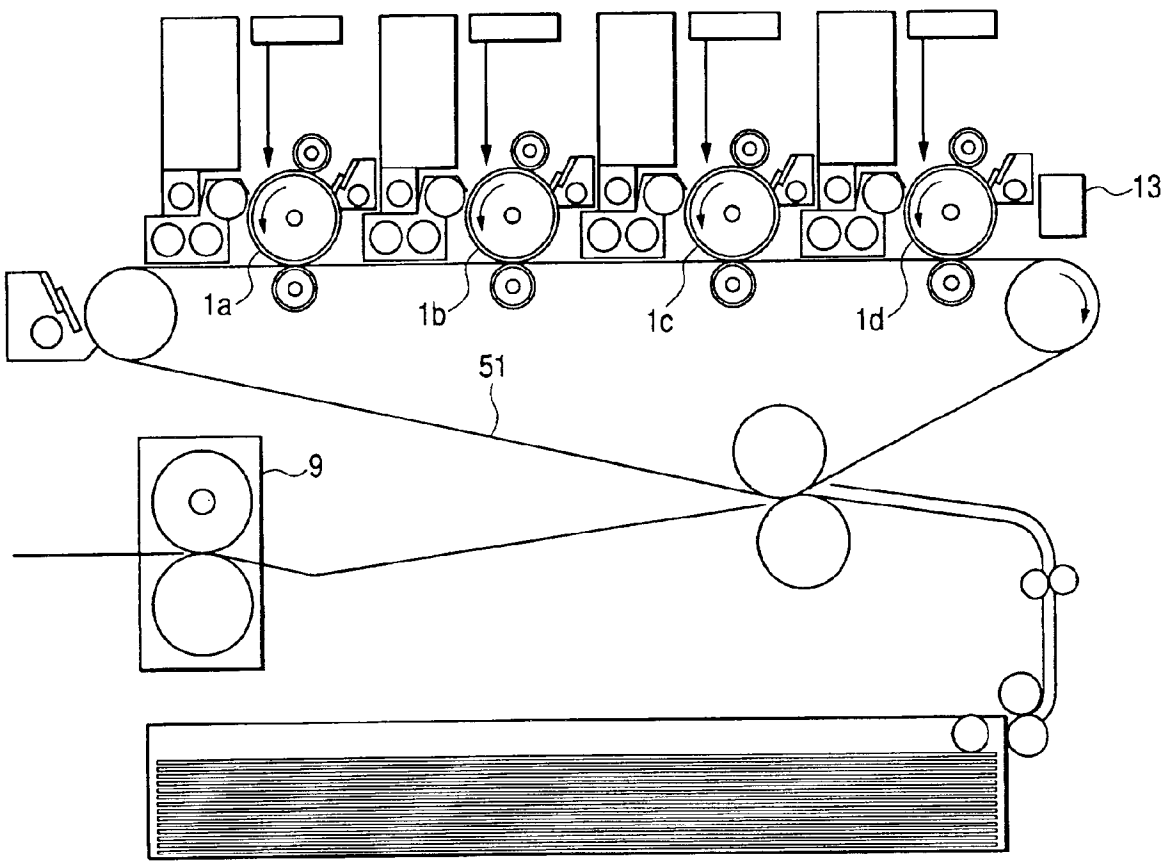
FIG. 18 is a view showing a schematic structure of a color image forming apparatus using an intermediate transfer member.
Figure 19:
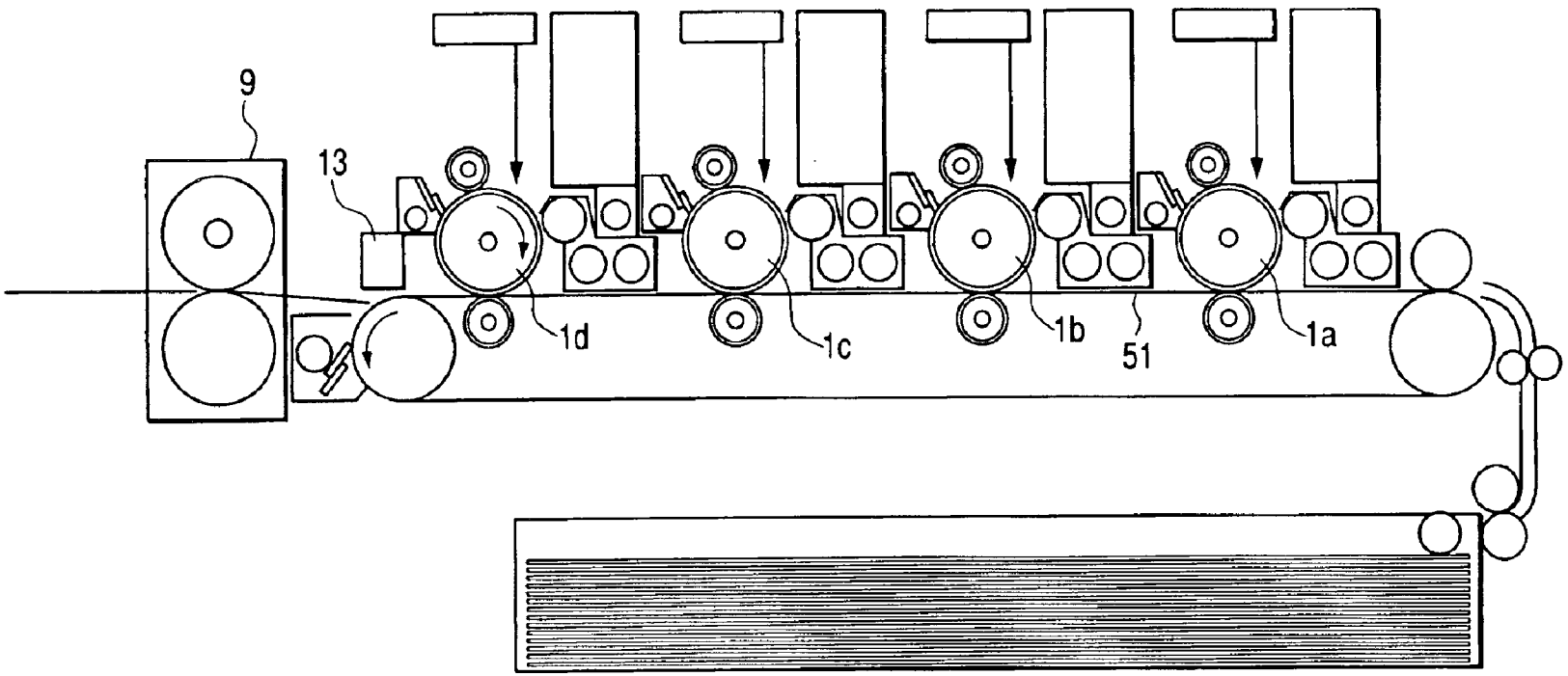
FIG. 19 is a view showing a schematic structure of a color image forming apparatus using a transfer belt.

Further, in this embodiment, a patch image is formed on a photosensitive body and transferred to a transfer sheet, and then, a density of the patch image is detected on the transfer sheet by the patch sensor 13. However, the present invention is not limited to this, and it does not matter at all if a density of a patch image is detected on a photosensitive body, an intermediate transfer member (FIG. 18) or a recording material bearing member of a belt shape (FIG. 19).

The patch sensor 13 is constituted of PDs 13*e*, 13*f* and 13*g* and prisms 13*h* and 13*i*. Light irradiated by an LED 13*c* is split into a component vibrating in a vertical direction with respect to an incident surface (s-wave light) and a component vibrating in a parallel direction with respect to the incident surface (p-wave light) by the prism 13*h*.

The s-wave light is irradiated on the PD 13*e* in the vicinity of the LED 13*c* and the p-wave light is irradiated on a toner surface. In this embodiment, the p-wave light, which is incident on a surface to be a background in detecting a density of a patch image on the transfer sheet 5*f* (the photosensitive member, the intermediate transfer member, etc.), is generally reflected regularly and is transmitted through the prism 13*i* to be incident on the PD 13*f* with regular reflection light as a p-wave. The p-wave light irradiated on the toner surface is diffusely reflected and split into a p-wave and an s-wave with a part of the p-wave light turning into the s-wave. Transmitted through the prism 13*i*, the p-wave is incident on the PD 13*f* and detected as regular reflection light, and the s-wave is incident on the PD 13*g* and detected as diffuse reflection light. Thus, the PD 13*f* functions as regular reflection light amount detecting means and the PD 13*g* functions as diffuse reflection light amount detecting means.

In this embodiment, a diffuse reflection component is considered to be incident on the PD 13*f* as well. Thus, a real regular reflection output is obtained by deducting a product found by multiplying an output value B of the s-wave of the PD 13*g* by a certain correction coefficient k from an output value A of the p-wave of the PD 13*f*, that is, from the following expression. The correction coefficient k can be set variably by the CPU 300 as described later.

Corrected output="Regular reflection light amount (p-wave) output" (A)−"Diffuse reflection light amount (s-wave) output" (B)×Correction coefficient (k)

Based on a corrected output obtained in this way, a weight ratio of toner and carrier (a toner supply amount), operating conditions (an applied bias etc.) of image forming means involved in image formation (a charger, a developing device, a transfer charger, etc.), that is, image forming conditions are controlled such that an image is formed on the photosensitive drum with an accurate density.

However, conventionally, since the correction coefficient of the patch sensor 13 is set as a fixed value, a ratio of outputs of a p-wave and an s-wave, that is, "p-wave output"/"s-wave output" equals the correction coefficient. Thus, variation of the correction coefficient due to an individual difference or an attachment error of the patch sensor 13 is large.

Therefore, in the present invention, the correction coefficient in the above expression in the state in which the patch sensor 13 is actually attached taking into account individual differences of p-wave and s-wave outputs due to the patch sensor 13 is optimized by the CPU 300 functioning as control means. That is, the correction coefficient k can be variably set so as to eliminate an individual difference of a patch sensor.

In addition, in this embodiment, a developed image for density detection (patch) is formed such that a density becomes higher than that at the time of normal image formation, a patch with a high density is assumed to be a developed image for correcting density detection (correction patch), and a regular reflection light amount and a diffuse reflection light amount are read by the patch sensor from this correction patch to perform correction of the density detecting mechanism.

In order to form a patch so as to have a density higher than that at the time of normal image formation and correct the density detecting mechanism by the patch sensor 13, in this embodiment, a correction patch formed on the photosensitive drum 1 is transferred to the transfer sheet 5*f* in the state in which a grid potential of the corona charger 2, a developing bias potential to be applied to the developing sleeve 41, and the like are set using the electro static voltmeter 12 and known potential control means or the like such that a development contrast 1.5 times as large as a development contrast used at the time of normal image formation is realized, and a correction patch of a 2 cm square with an image density of 100% is formed. This correction patch is read by the patch sensor 13.

This is for forming a correction patch with an increased bearing amount of toner, thereby removing a regular reflection component by the background (removing a noise component due to light from a surface of a transfer sheet on which a patch is formed), and turning almost all reflected light received by the patch sensor 13 into diffuse reflection light to cause both the two PDs 13*f* and 13*g* to practically receive only s-wave light. Consequently, a ratio of outputs according to reception of s-wave light in the two PDs 13*f* and 13*g* can be obtained.

This correction patch for obtaining a correction coefficient is formed such that a development contrast larger than a development contrast used at the time of normal image formation (1.5 times as large in this embodiment) is realized. This is because, even if variation in a density (in particular, decrease in a density) of a main body occurs, a toner amount can always be obtained which allows sufficient removal of a regular reflection component reflected back from the background.

If this correction patch were formed in the same state as at the time of normal image formation to make it a patch with the same density as usually obtained, it is likely that a toner amount allowing sufficient removal of a regular reflection component reflected back from the background cannot be obtained and an appropriate correction coefficient cannot be obtained depending on a magnitude of variation in a density of the main body.

A correction patch with a higher density than usual is formed to obtain a ratio of a regular reflection light amount and a diffuse reflection light amount obtained from the correction patch, whereby correction of the density detecting mechanism by the patch sensor 13 (change of a method of deriving a corrected output), that is, correction (change) of a correction coefficient is performed. Consequently, accurate density detection becomes possible regardless of variation in a density of the main body.

Here, if a correction patch with a higher density than usual is formed, means for forming the correction patch is not limited to increasing a development contrast.

Now, effects according to this embodiment will hereinafter be described.

Figure 4A:
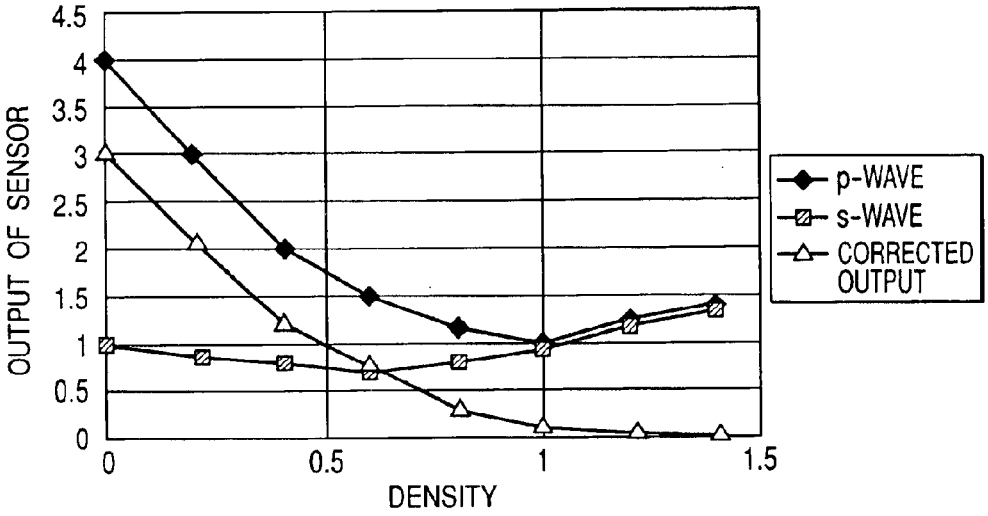
FIGS. 4A and 4B are graphs showing outputs of p-waves and s-waves detected by two different density detecting means, to which a conventional density detecting mechanism is applied, and corrected outputs.
Figure 4B:
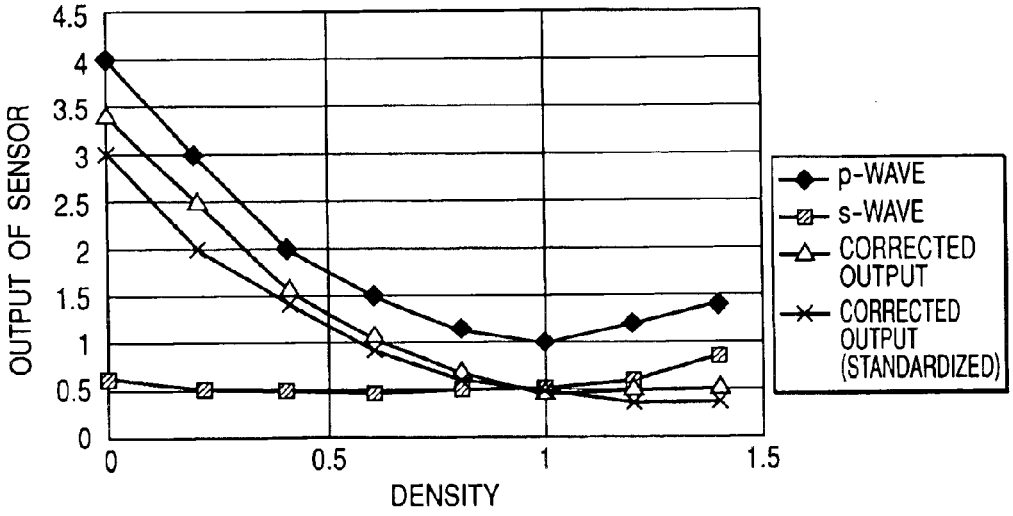

FIGS. 4A and 4B are graphs showing outputs with respect to densities in the case where a correction coefficient is set as a fixed value in certain two different patch sensors 13 and corrected outputs (="p-wave output"−"s-wave output"× Correction coefficient). The patch sensor 13 in FIG. 4A is referred to as a patch sensor A and the patch sensor 13 in FIG. 4B is referred to as a patch sensor B. In FIGS. 4A and 4B, a fixed value was used as a correction coefficient, a background, that is, a density 0 (zero) was measured by the patch sensors A and B, and outputs were standardized based on a measured value of the background for the patch sensor A. As it can be seen from the graphs, even if outputs are standardized at the density 0 (zero), that is, the background, corrected outputs in these two different patch sensors 13 show different characteristics particularly in a high density part.

Thus, in this embodiment, a correction patch was detected which was formed in the state in which a grid potential of the corona charger 2, a developing bias potential to be applied to the developing sleeve 41 and the like were set using known potential control means or the like such that a development contrast 1.5 times as large as a development contrast used at the time of normal image formation was realized, and correction coefficients were calculated from a p-wave and an s-wave at that time, respectively. Note that it is assumed that Correction coefficient="p-wave output in correction patch"/"s-wave output in correction patch".

In this way, in the case of the patch sensor A, Correction coefficient="p-wave output"/"s-wave output"=1.6/1.6=1. In the case of the patch sensor B, Correction coefficient="p-wave output"/"s-wave output"=1.6/0.96=1.67. Corrected outputs were found using these correction coefficients.

Figure 3A:
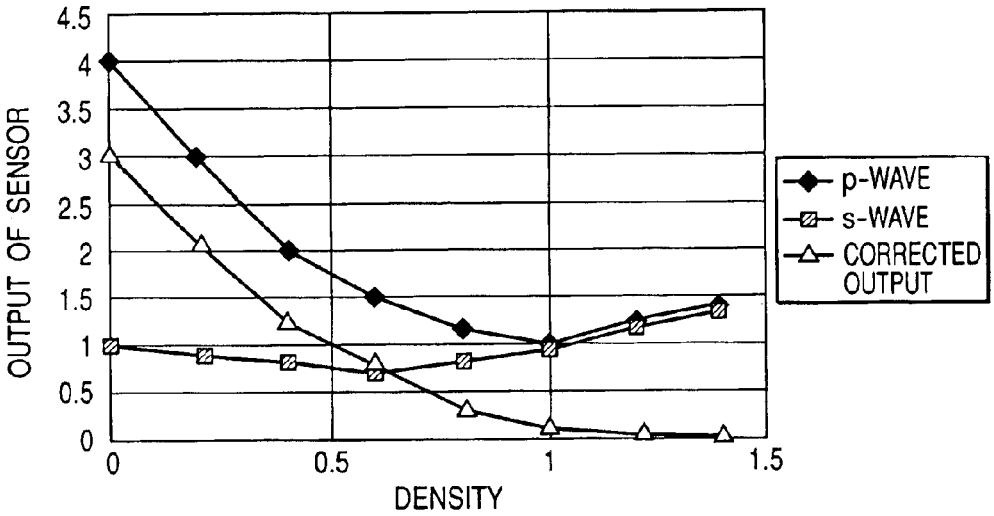
FIGS. 3A and 3B are graphs showing outputs of p-waves and s-waves detected by two different density detecting means, to which a density detecting mechanism in accordance with the present invention is applied, and corrected outputs.
Figure 3B:
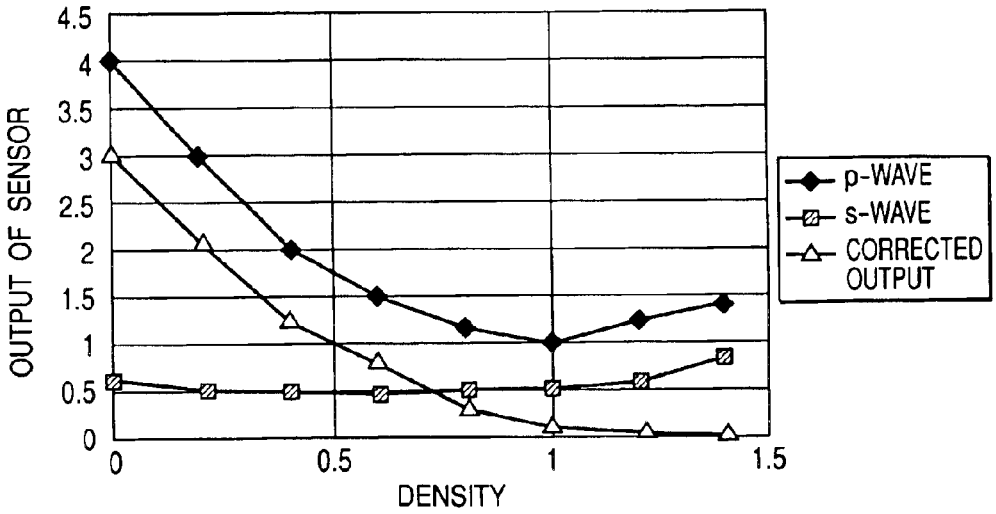

It can be seen that the corrected outputs found using these correction coefficients show similar output characteristics in both the different patch sensors at the same density as shown in FIG. 3A for the patch sensor A and FIG. 3B for the patch sensor B.

As in this embodiment, a patch sensor functioning as an optical sensor for detecting a development density of a visualized toner image by regular reflection light and diffuse reflection light was provided, a correction patch that was set such that a density became higher than at the time of normal image formation was read by the patch sensor, and correction of the density detecting mechanism of the patch sensor was performed. Consequently, densities could be detected with high accuracy regardless of individual differences and attachment accuracy of patch sensors.

Further, the present invention can be applied to an image forming apparatus of any structure as long as the image forming apparatus controls image forming conditions of image forming means according to a patch image density detected from a developed image for density detection by density detecting means, and is not limited to the one with the structure shown in FIG. 2.

In addition, the image forming conditions of the image forming means include control of a toner supply amount to a developing device and adjustment and control of a primary charging bias, a developing bias and a transfer bias as described above.

Second Embodiment

This embodiment is an example in which the present invention is applied to a system without potential controlling means. The same parts as those in the first embodiment will be omitted in the following descriptions.

In this embodiment, a correction patch was formed using a laser power 1.8 times as large as that used at the time of normal image formation instead of changing a development contrast in forming a patch for calculating a correction coefficient (correction patch), a correction coefficient was found by the expression "p-wave output in correction patch"/"s-wave output in correction patch"="Correction coefficient" to perform a detection operation of densities.

In such a case, again, even if a change in a density of a main body (in particular, decrease in a density) occurred, a toner amount allowing sufficient removal of a regular reflection component reflected back from a background could be always obtained and an appropriate correction coefficient of a patch sensor could be found. Consequently, density detection of high accuracy could be performed.

Third Embodiment

This embodiment is the same as the first embodiment in its basic structure but is different in the manner of preparing a correction patch.

That is, in this embodiment, developed images for density detection (patches) of a plurality of colors are superimposed to form a multicolor developed image for density detection (multicolor patch) having a developer bearing amount (toner bearing amount) which is equal to or larger than a maximum developer bearing amount of a patch in a single color. Then, correction of a density detecting mechanism is performed by a patch sensor according to a regular reflection light amount and a diffuse reflection light amount obtained from the multicolor patch.

This is preferable in the case where it is difficult to form a dense correction patch image only by single color toner.

In this embodiment, in the image forming apparatus shown in FIG. 2, a degree of a developing bias output in a developing operation of the developing means 4 containing developer of three colors, yellow Y, magenta M and cyan C, respectively, is set to a maximum output (100%). Each color is superimposed and developed at outputs of Y 100%, M 100% and C 100% to form a multicolor developed image for density detection (multicolor patch) of a 2 cm square. A p-wave light amount of regular reflection light and an s-wave light amount of diffuse reflection light are detected by the patch sensor 13. Then, it is assumed that (p-wave output)/(s-wave output)=Correction coefficient.

This is for forming a multicolor patch with an increased bearing amount of toner, thereby removing a regular reflection component reflected back from the background, and turning almost all reflected light received by the patch sensor 13 into diffuse reflection light to cause both the two PDs 13*f* and 13*g* to practically receive only s-wave light. Consequently, a ratio of outputs according to reception of s-wave light in the two PDs 13*f* and 13*g* can be obtained.

Here, the multicolor patch for obtaining a correction coefficient is assumed to be the multicolor patch with 100% of Y, M and C, respectively, because, even if variation in a density of a main body (in particular, decrease in a density) occurs, a bearing amount of toner allowing sufficient removal of a regular reflection component reflected back from the background can be always obtained.

If a patch with 100% of a certain single color were used instead of the multicolor patch, it is likely that a bearing amount of toner allowing sufficient removal of a regular reflection component reflected back from the background cannot be obtained and an appropriate correction coefficient cannot be obtained.

The multicolor patch is formed by superimposing patches of a plurality of colors, whereby it becomes possible to realize a patch having a bearing amount of toner equal to or larger than a bearing amount of toner with 100% of single color output. Then, a ratio of a regular reflection light amount and a diffuse reflection light amount obtained from the multicolor patch is obtained, whereby correction of the density detecting mechanism by the patch sensor 13, that is, correction of a correction coefficient is performed. Consequently, accurate density detection becomes possible regardless of variation in a density of the main body.

Further, it is sufficient that the multicolor patch is formed by developing means of a plurality of colors, and the number of colors and development output of each developing means are not limited to those described above. However, a bearing amount of toner of the multicolor patch is required to be equal to or more than a bearing amount of toner of a patch that is formed at a maximum output or more of one single color developing means.

Here, effects according to this embodiment will be hereinafter described.

Figure 6A:
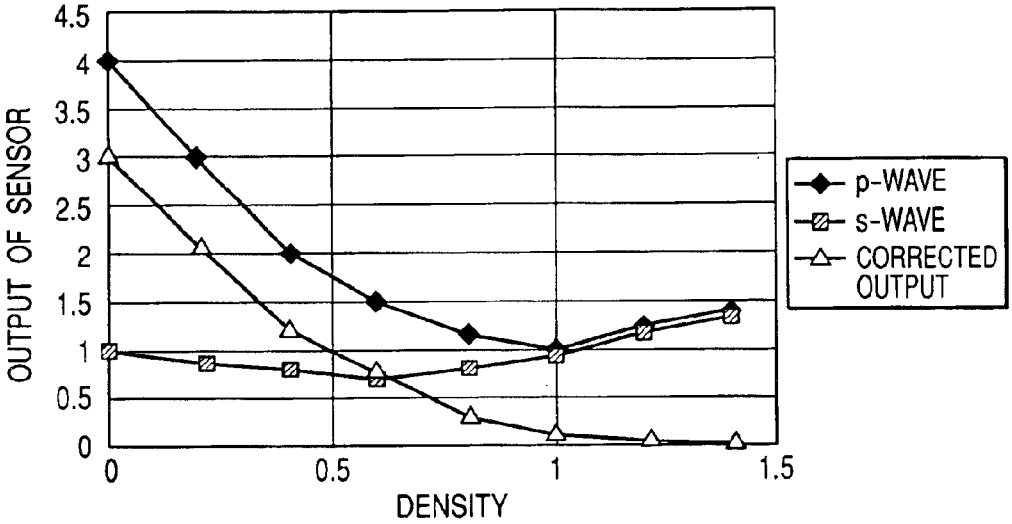
FIGS. 6A and 6B are graphs showing outputs of p-waves and s-waves detected by two different density detecting means, to which the conventional density detecting mechanism is applied, and corrected outputs.
Figure 6B:
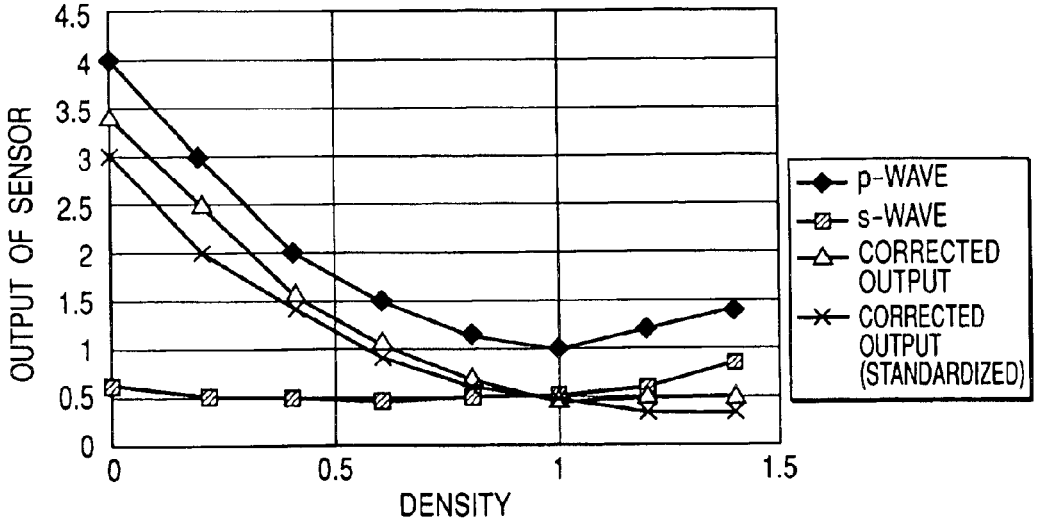

FIGS. 6A and 6B are graphs showing outputs with respect to densities in the case where a correction coefficient is set to be a fixed value in certain two different patch sensors 13 and corrected outputs (="p-wave output"−"s-wave output"× Correction coefficient). The patch sensor 13 in FIG. 6A is referred to as a patch sensor A and the patch sensor 13 in FIG. 6B is referred to as a patch sensor B. In FIGS. 6A and 6B, a background, that is, a density 0 (zero) was measured by the patch sensors A and B to find a correction coefficient, and outputs were standardized based on a measured value of the background by the patch sensor A. As it can be seen from the graphs, even if outputs are standardized at the density 0 (zero), that is, the background, corrected outputs in these two different patch sensors 13 show different characteristics particularly in a high density part.

Thus, in this embodiment, a multicolor patch was detected which was formed using developing means of a plurality of colors and had a bearing amount of toner equal to or larger than a bearing amount of toner of a single color patch formed at a maximum output, and correction coefficients were calculated from a p-wave and an s-wave at that time, respectively. Note that it is assumed that Correction coefficient="p-wave output in multicolor patch"/"s-wave output in multicolor patch".

In this way, in the case of the patch sensor A, Correction coefficient="p-wave output"/"s-wave output"=1.6/1.6=1. In the case of the patch sensor B, Correction coefficient="p-wave output"/"s-wave output"=1.6/0.96=1.67. Corrected outputs were found using these correction coefficients.

Figure 5A:
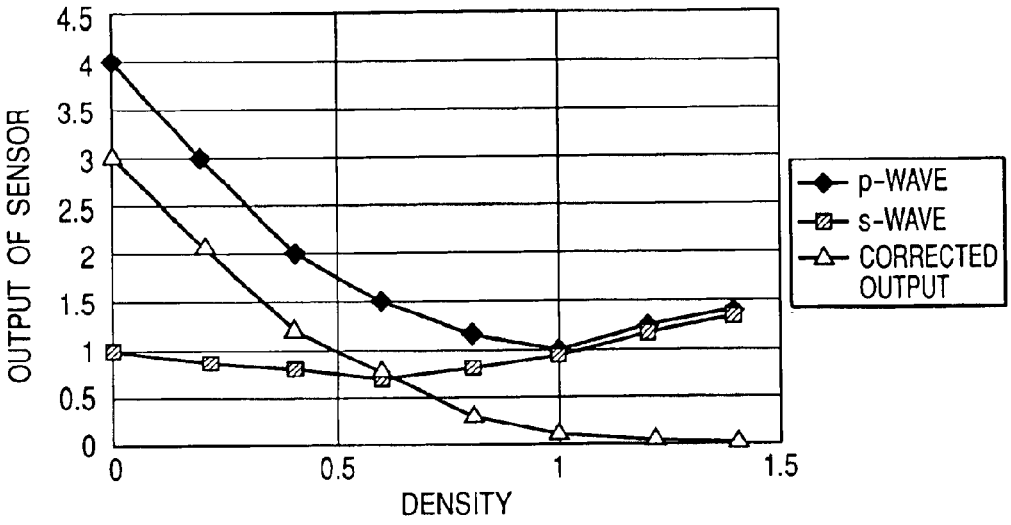
FIGS. 5A and 5B are graphs showing outputs of p-waves and s-waves detected by two different density detecting means, to which the density detecting mechanism in accordance with the present invention is applied, and corrected outputs.
Figure 5B:
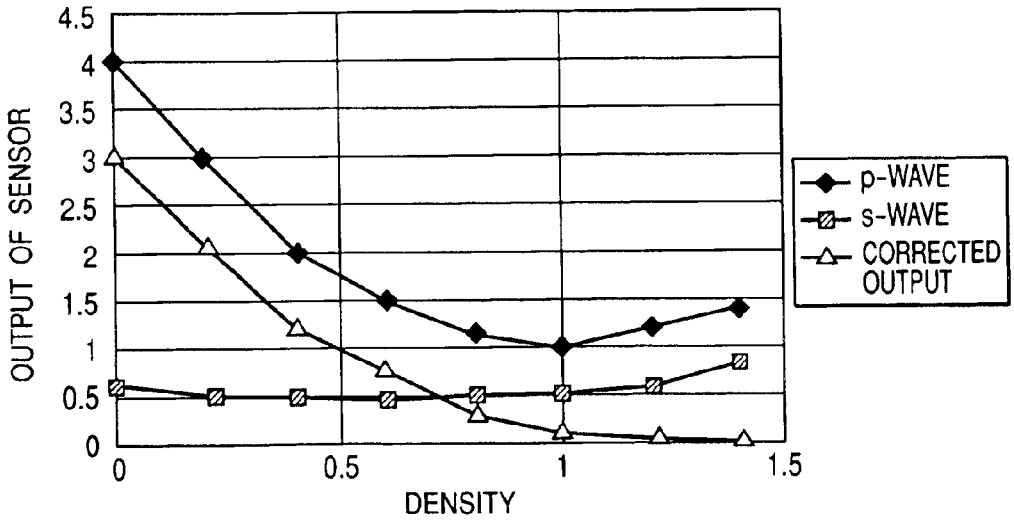

It can be seen that the corrected outputs found using these correction coefficients show similar output characteristics in both the different patch sensors at the same density as shown in FIG. 5A for the patch sensor A and FIG. 5B for the patch sensor B.

As in this embodiment, a patch sensor functioning as an optical sensor for detecting a development density of a visualized toner image by regular reflection light and diffuse reflection light was provided, a regular reflection light amount and a diffuse reflection light amount in a multicolor patch, which was formed by superimposing a plurality of colors to have a bearing amount of toner equal to or larger than a maximum bearing amount of toner in a single color, was read by the patch sensor, and correction of a density detecting mechanism of the patch sensor was performed. Consequently, densities could be detected with high accuracy regardless of an individual difference and attachment accuracy of a patch sensor.

Further, the present invention can be applied to an image forming apparatus of any structure as long as the image forming apparatus controls image forming conditions according to a development density detected from a developed image for density detection by density detecting means, and is not limited to the one with the structure shown in FIG. 2.

Fourth Embodiment

This embodiment is the same as the above-mentioned embodiments in its basic structure but is different in the manner of preparing a correction patch.

That is, in this embodiment, a correction patch of a 2 cm square of a desired image density, for example, an image density of 100% is formed in the state where a development contrast or the like is adjusted such that a desired reference density is obtained by measurement by an existing density detection sensor, and the correction patch is read by the optical sensor 13. It is assumed that a ratio of outputs of a p-wave and an s-wave at that time, that is, "p-wave output (output of the photodiode 13*f*)"/"s-wave output (output of the photodiode 13*g*)" is a correction coefficient. That is, Correction coefficient=p-wave output (output of the photodiode 13*f*)/s-wave output (output of the photodiode 13*g*).

This is for correcting variation of outputs of a sensor due to an individual difference of a sensor and accuracy of attaching a sensor to an apparatus main body by obtaining "output of the photodiode 13*f*"/"output of the photodiode 13*g*", that is, a correction coefficient in detecting a toner patch of a reference density by the optical sensor 13.

When the correction coefficient thus obtained is used in the foregoing correction expression, Corrected output="p-wave output (output of the photodiode 13*f*)"−"s-wave output (output of the photodiode 13*g*)"×Correction coefficient, the outputs are corrected such that a corrected output =0 (zero) at a reference density.

Next, this embodiment will be described more specifically with reference to FIGS. 7 to 10.

Figure 7:
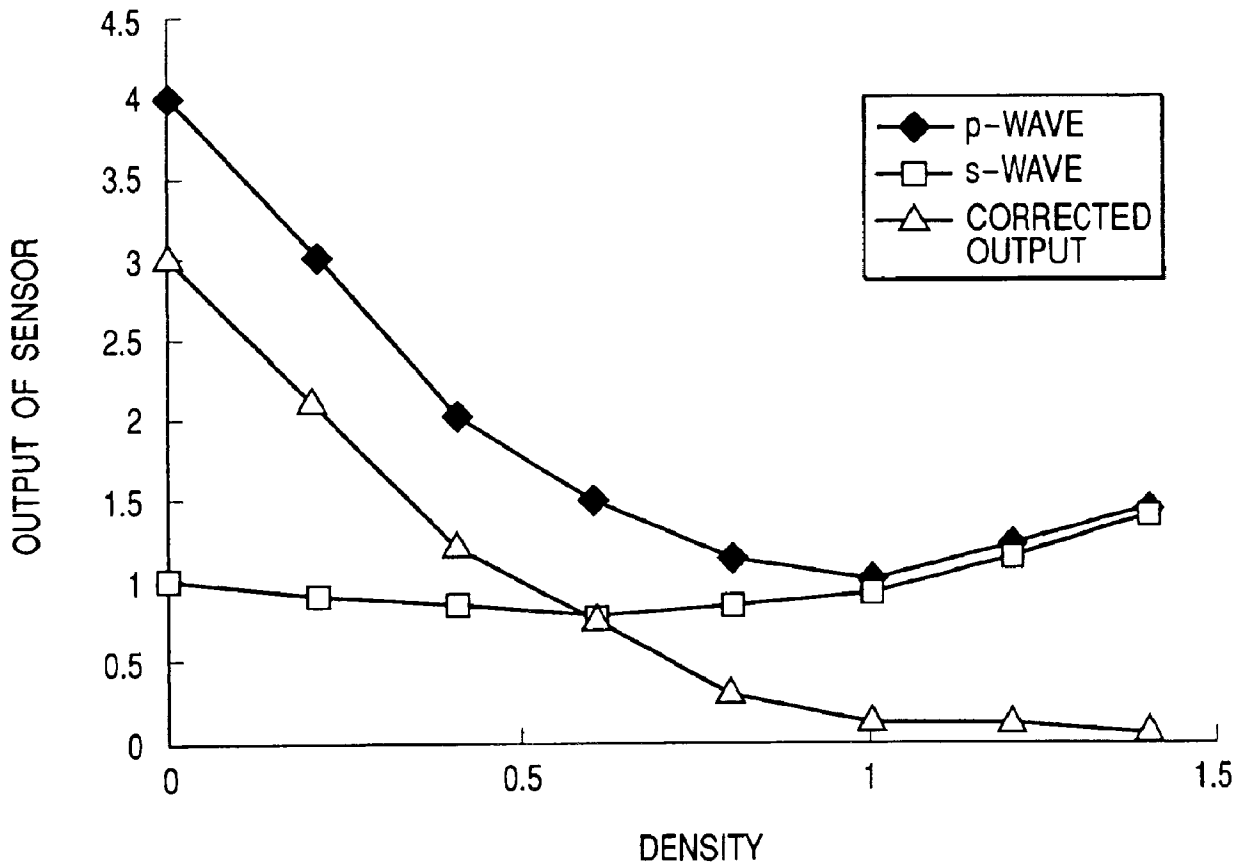
FIG. 7 is a graph showing sensor outputs and corrected sensor outputs with respect to toner image densities in one density detection sensor.
Figure 8:
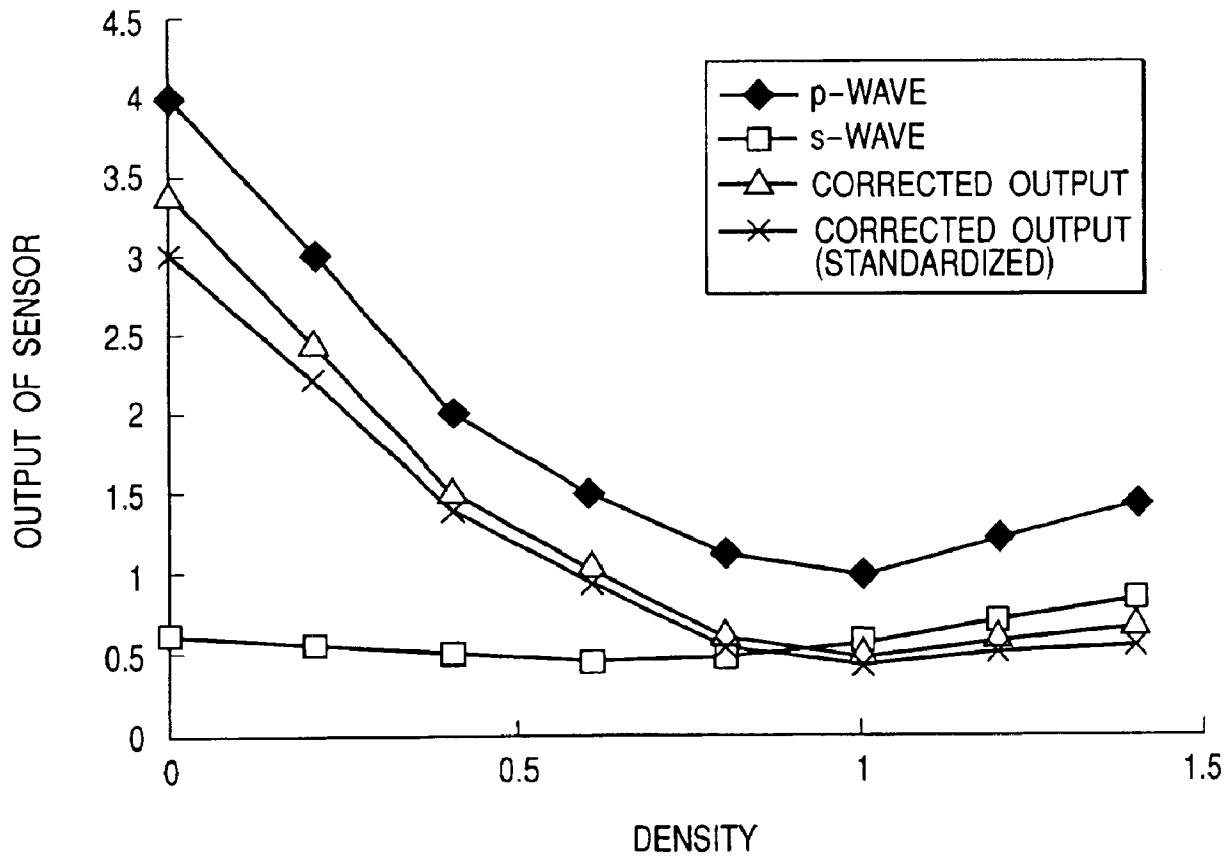
FIG. 8 is a graph showing sensor outputs and corrected sensor outputs with respect to toner image densities in another density detection sensor that is different from the sensor shown in FIG. 7.

FIGS. 7 and 8 are graphs showing outputs of a sensor, that is, p-wave outputs (outputs of the photodiode 13*f*) and s-wave outputs (outputs of the photodiode 13*g*) with respect to toner image densities in the case where a correction coefficient is set to be a fixed value in certain two different patch sensors 13 and outputs of the sensor after correction (i.e., corrected outputs of the sensor) (="photodiode 13*f* outputs"−"photodiode 13*g* outputs"×Correction coefficient).

As it can be seen from the graphs, even if outputs are standardized at the density 0 (zero), that is, the background, corrected outputs of the sensor in these two different patch sensors 13 show different characteristics particularly in a high density part.

Figure 9:
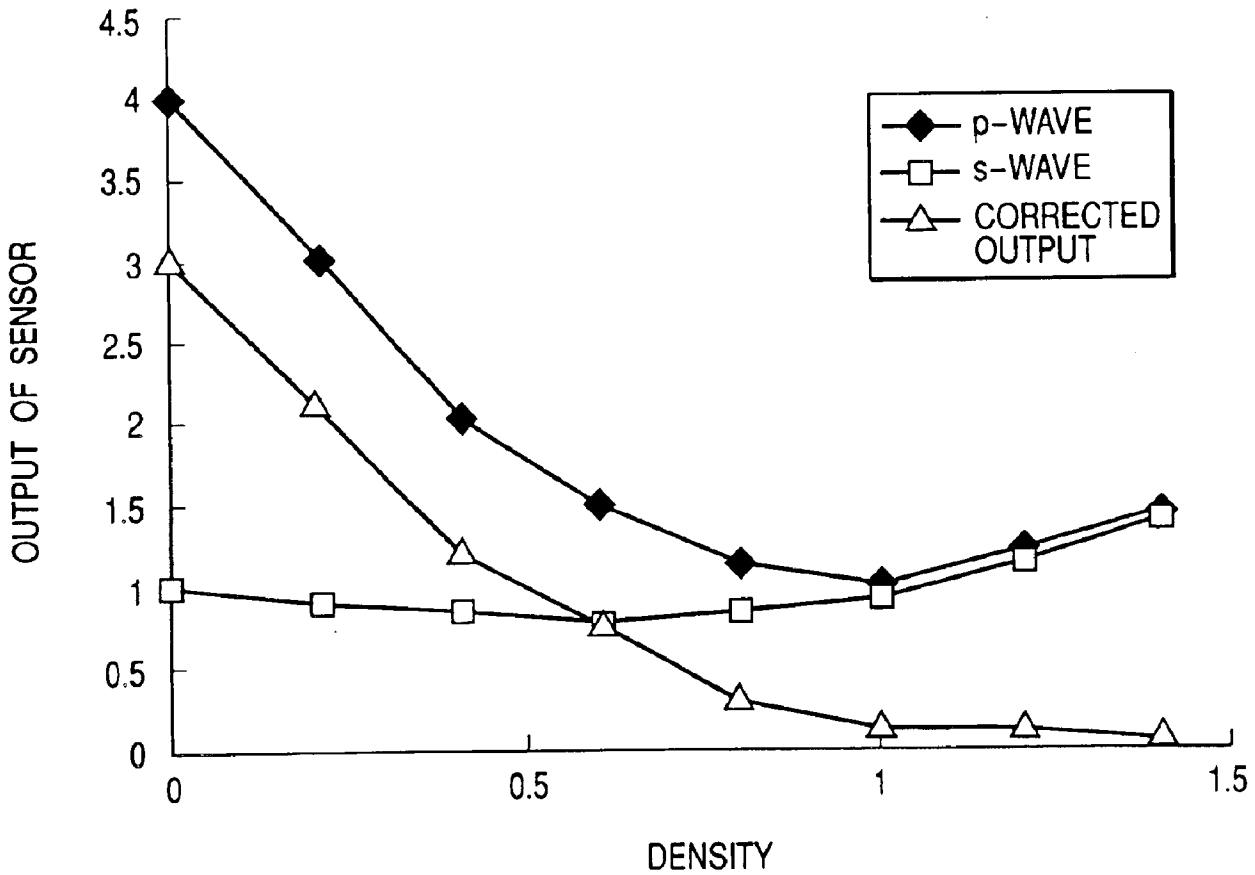
FIG. 9 is a graph showing sensor outputs and corrected sensor outputs with respect to toner image densities in the density detection sensor shown in FIG. 7 which are corrected in accordance with the present invention.
Figure 10:
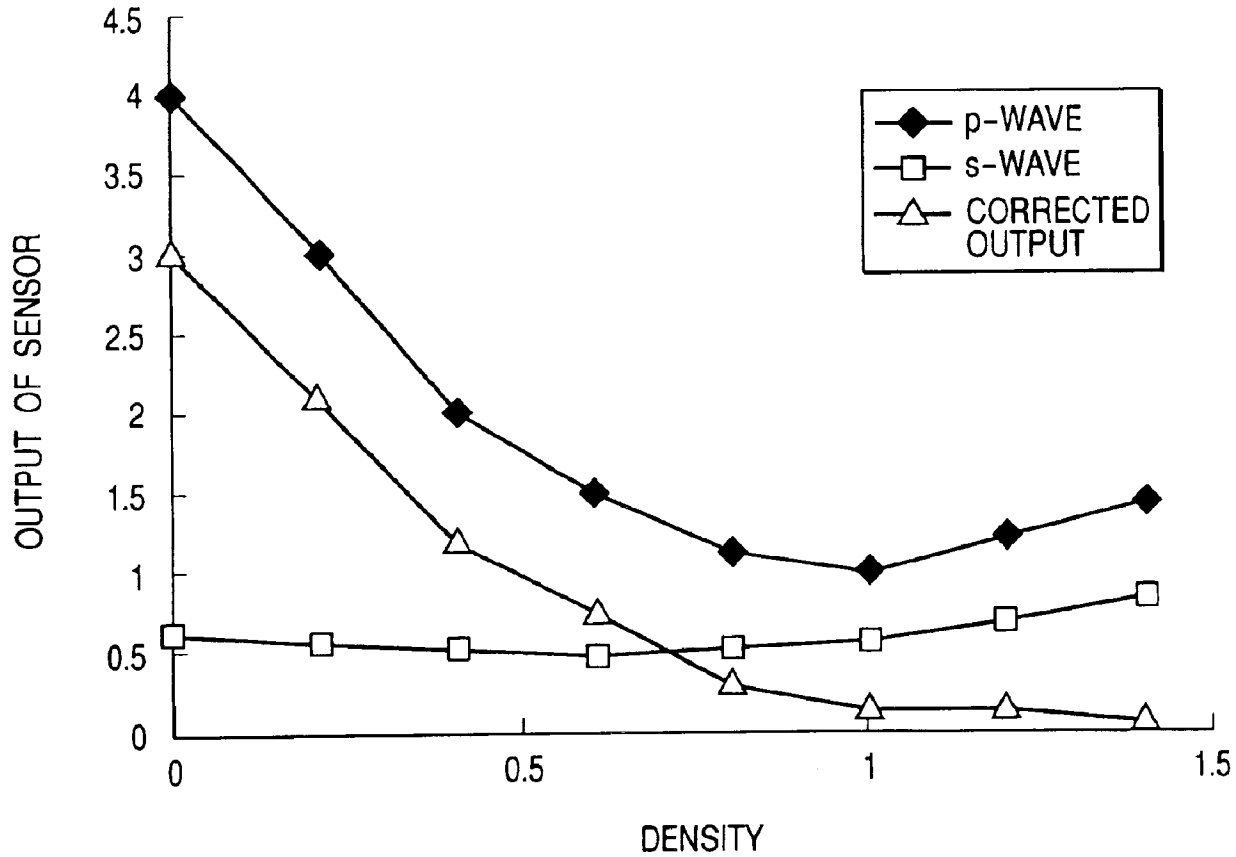
FIG. 10 is a graph showing sensor outputs and corrected sensor outputs with respect to toner image densities in the density detection sensor shown in FIG. 8 which are corrected in accordance with the present invention.
Figure 11:
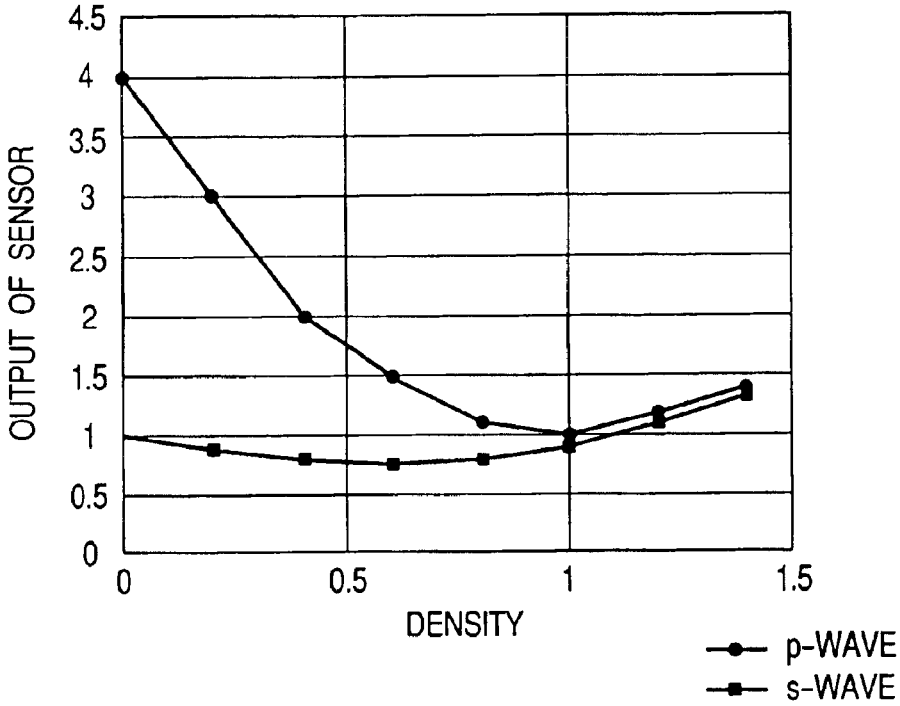
FIG. 11 is a graph showing detection results of a p-wave and an s-wave with respect to toner image densities.
Figure 12:
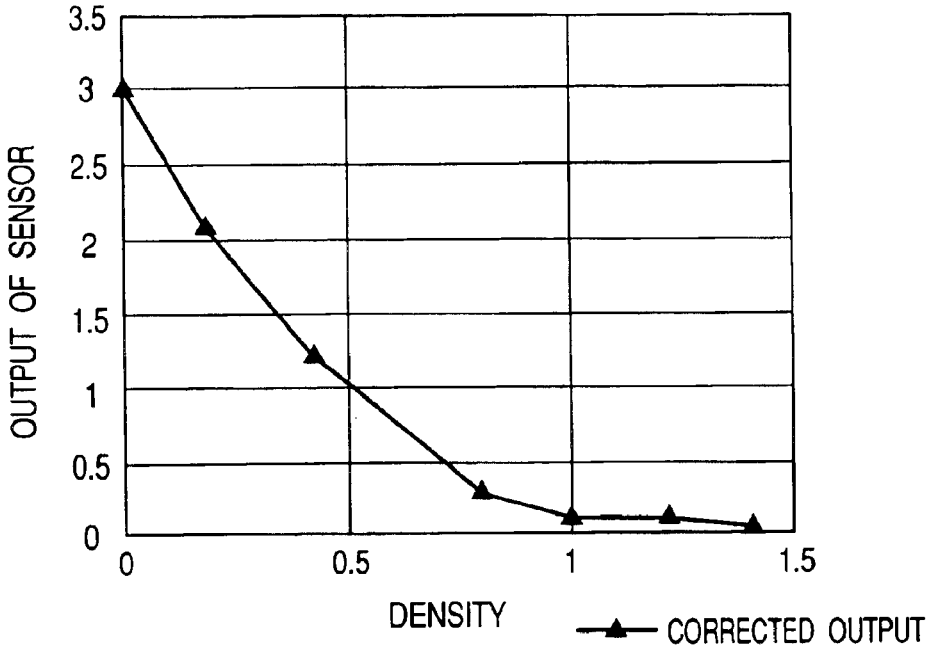
FIG. 12 is a graph showing corrected outputs with respect to toner image densities.

FIGS. 9 and 10 show results of correcting two sensors having different characteristics as shown in FIGS. 7 and 8 in accordance with this embodiment. According to the present invention, it can be seen that both the sensors show similar output characteristics.

That is, according to the present invention, first, a correction patch is detected which is formed in the state where a grid potential of the corona charger 2, a developing bias potential to be applied to the developing sleeve 41 and the like are adjusted to have a desired density, that is, a reference density 1.4 in this embodiment. Then, correction coefficients are calculated from a p-wave output (output of the photodiode 13*f*) and an s-wave output (output of the photodiode 13*g*) at that time, respectively.

In the case of FIG. 7, Correction coefficient="p-wave output"/"s-wave output"=1.4/1.4=1. In the case of FIG. 8, Correction coefficient="p-wave output"/"s-wave output"= 1.4/0.96=1.46. Corrected outputs of the sensor are found using these correction coefficients. Results of finding the corrected outputs are shown in FIGS. 9 and 10. It can be seen from FIGS. 9 and 10 that both the sensors show similar output characteristics.

As in this embodiment, an optical sensor for detecting a visualized toner image density by regular reflection light and diffuse reflection light is provided, a toner patch under image forming conditions for obtaining a desired image density is formed and read by the optical sensor, and correction of the optical sensor is performed. Consequently, densities can be detected with high accuracy regardless of individual differences and attachment accuracy of optical sensors.

Further, formation of a toner patch at a desired density (i.e., reference density) and correction of a sensor according to the toner patch are basically performed in a manufacturing process of an apparatus. In addition, it is also possible to perform them by a service man or the like when the sensor is replaced in the market.

Fifth Embodiment

As described above, a density detection sensor used in this embodiment has two photodiodes. A relative ratio of outputs of these two photodiodes varies due to an individual difference of a density detection sensor or accuracy of attaching the density detection sensor to an apparatus main body. Therefore, correction for optimizing individual differences of the density detection sensor and variation in the state where the density detection sensor is actually attached is important.

Figure 13:
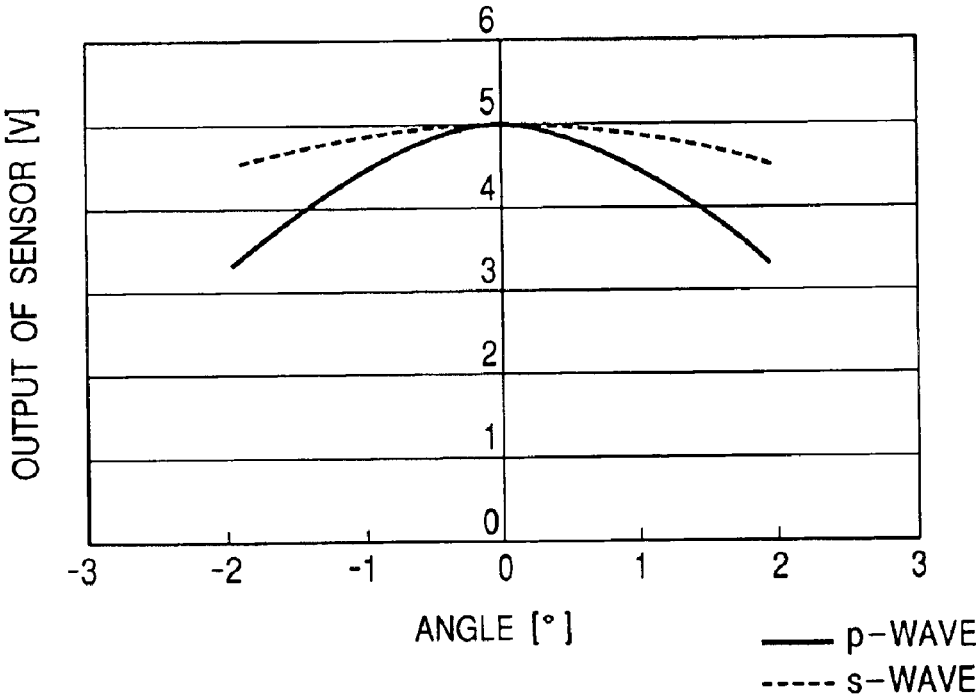
FIG. 13 is a graph showing detection results of a p-wave and an s-wave with respect to attachment angles.

FIG. 13 is a graph showing detection results of a p-wave and an s-wave with respect to attachment angles. An attachment angle 0° indicates a correct attachment position for attaching the photodiodes to the apparatus main body. Outputs of the sensor at the time when an attachment angle varies are shown with the attachment angle 0° in the center. It can be seen that outputs of a sensor of the p-wave with a large regular reflection component change largely with respect to an angle, whereas outputs of a sensor of the s-wave with a large scattering component change a little with respect to an angle. Therefore, in Expression (1), Corrected output="p-wave output"−"s-wave output"× Correction coefficient, a ratio of a p-wave output and an s-wave output changes according to an angle. Thus, even if a corrected output is further standardized, an output with respect to a density is not determined uniquely, which becomes a significant factor of an error.

Figure 14:
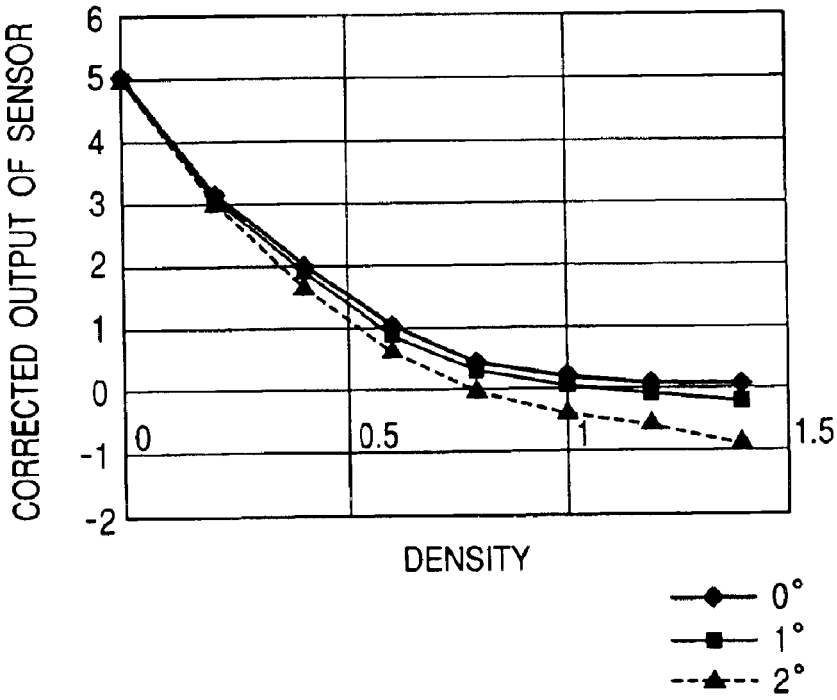
FIG. 14 is a graph showing corrected outputs that are standardized using Expression (1)
Figure 15:
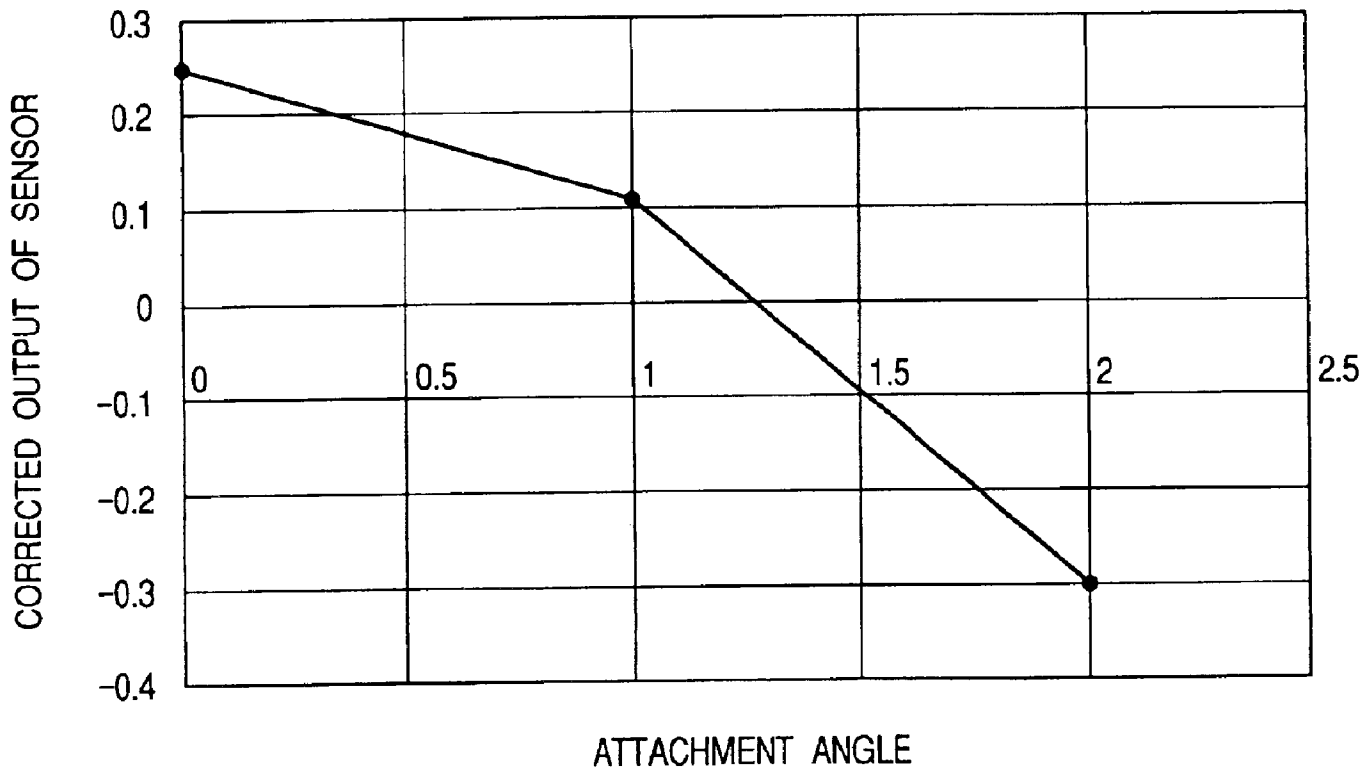
FIG. 15 is a graph showing a relationship between attachment angles and corrected outputs that are standardized using Expression (1) when the density is 1.0.

FIG. 14 shows corrected outputs that are standardized using Expression (1). Expression (1) is applied to attachment angles 0°, 1° and 2° to standardize corrected outputs of the sensor such that the corrected output is 5 in the state where there is no toner. For example, it can be seen that, when a toner patch of a density of 1.0 is read, an error of a corrected output changes according to an attachment angle. FIG. 15 shows a relationship between attachment angles and corrected outputs at the time when the density is 1.0. In this embodiment, since an attachment angle tolerance is ±1°, a density error in the order of 0.13 is detected at the time when the density is 1.0 if a worst value is taken into account.

In this embodiment, a sensor correction process as described below is executed by a control portion for controlling a printer portion. Before performing density control, densities over one revolution of a transfer drum is read by the density detection sensor in order to detect a background in the state where a toner patch is not formed. In this case, it is assumed as follows:

1/p-wave output average value=p-wave correction coefficient;

1/s-wave output average value=s-wave correction coefficient; and

Corrected output="p-wave output"×"p-wave correction coefficient"−"s-wave output"×"s-wave correction coefficient"×Correction coefficient . . . Expression (2). Further, instead of reading the background, a reference plate may be read. Correction of a toner density can be performed with high accuracy by independently correcting outputs of the sensor of the p-wave and outputs of the sensor of the s-wave whether any one of the background and the reference plate is used.

Figure 16:
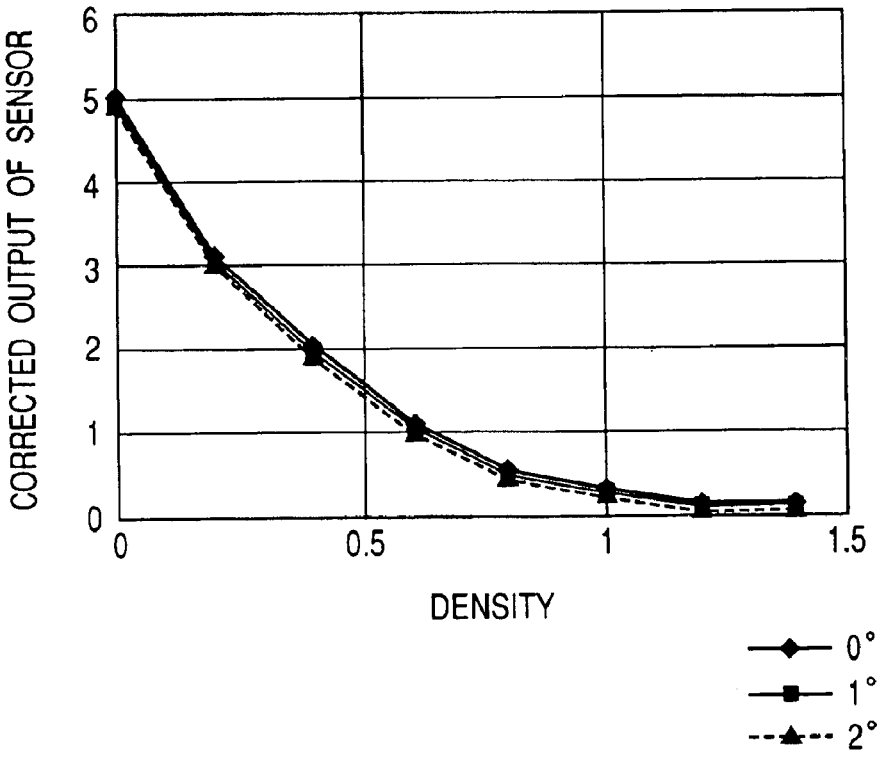
FIG. 16 is a graph showing corrected outputs that are standardized using Expression (2)

FIG. 16 shows corrected outputs that are standardized using Expression (2). As in the case of the corrected outputs shown in FIG. 14, Expression (2) is applied to attachment angles 0°, 1° and 2° to standardize corrected outputs of the sensor such that the corrected output is 5 in the state where there is no toner. For example, it can be seen that, when a toner patch of a density of 1.0 is read, there is little difference of a corrected output according to an attachment angle.

Figure 17:
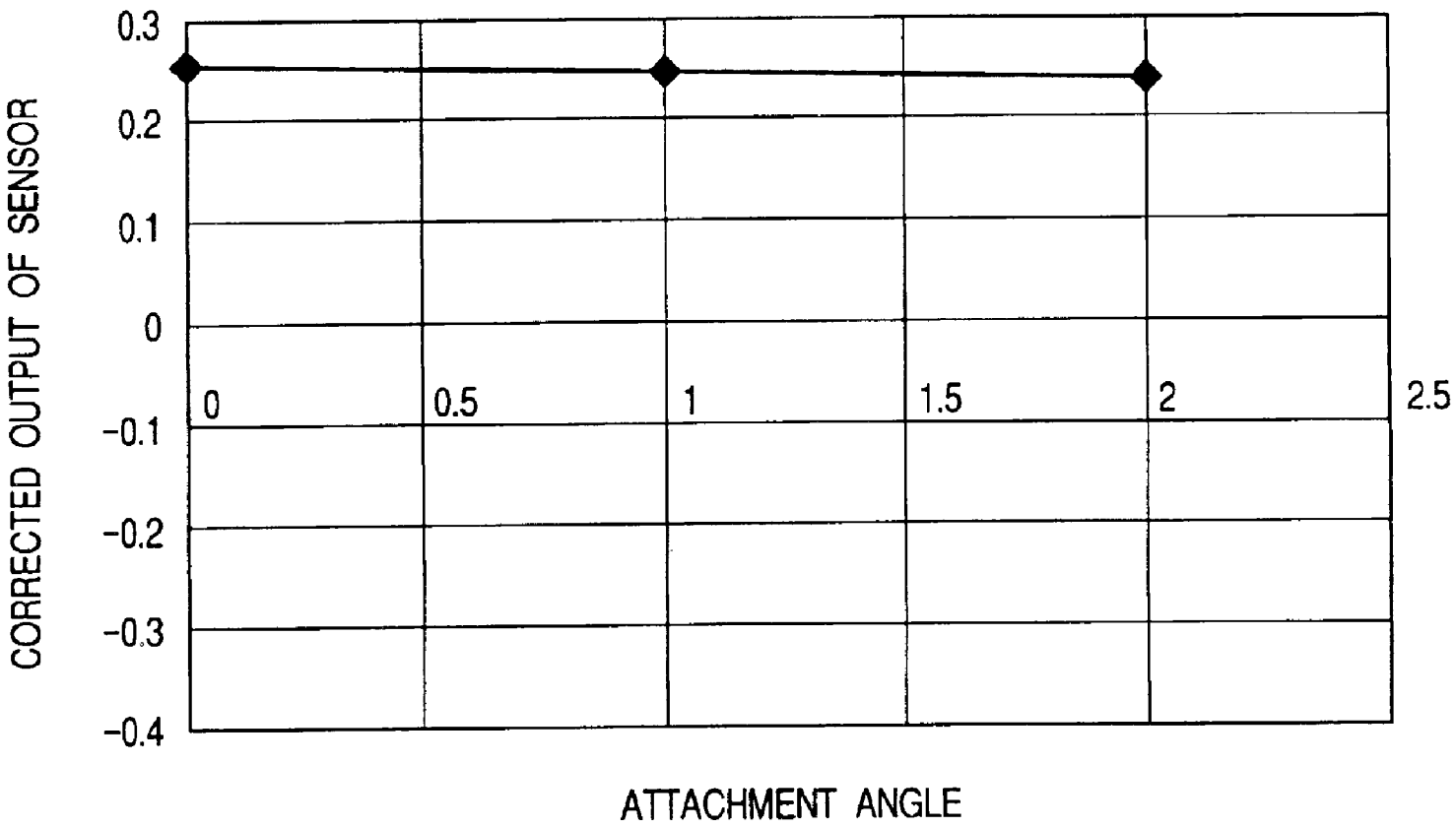
FIG. 17 is a graph showing a relationship between attachment angles and corrected outputs that are standardized using Expression (2) when the density is 1.0.

FIG. 17 shows a relationship between attachment angles and corrected outputs at the time when the density is 1.0. It can be seen that a sensor output variation due to variation of a state of attachment of photodiodes can be corrected with high accuracy from a low density to a high density. In this embodiment, since an attachment angle tolerance is ±1°, only a density error in the order of 0.02 is detected at the time when the density is 1.0 even if a worst value is taken into account. Although the attachment angles of 0° to 2° are described in this embodiment, it is needless to mention that an angle exceeding 2° can also be corrected.

According to this embodiment, the image forming apparatus has an optical sensor for detecting a visualized toner image density by regular reflection light and diffuse reflection light irradiated on the transfer drum and can detect a toner density with high accuracy regardless of individual differences and attachment accuracy of optical sensors by correcting an output of the optical sensor by regular reflection light and an output of the optical sensor by diffuse reflection light with different correction coefficients, respectively.

This embodiment is described with the transfer drum as an example of a transfer member. However, the present invention can be applied to transfer members other than the transfer drum in the same manner. FIG. 18 shows a schematic structure of a color image forming apparatus using an intermediate transfer member. For example, the color image forming apparatus may be a full color electrophotographic image forming apparatus using an intermediate transfer belt 51 as a transfer member. A density detection sensor 13 is placed so as to oppose the intermediate transfer belt 51. FIG. 19 shows a schematic structure of a color image forming apparatus using a transfer belt. In an image forming apparatus using a direct multiple transfer process, a transfer belt 51 is used as a transfer member, and the density detection sensor 13 is placed so as to oppose the transfer belt 51 in the same manner.

Sixth Embodiment

Figure 20:
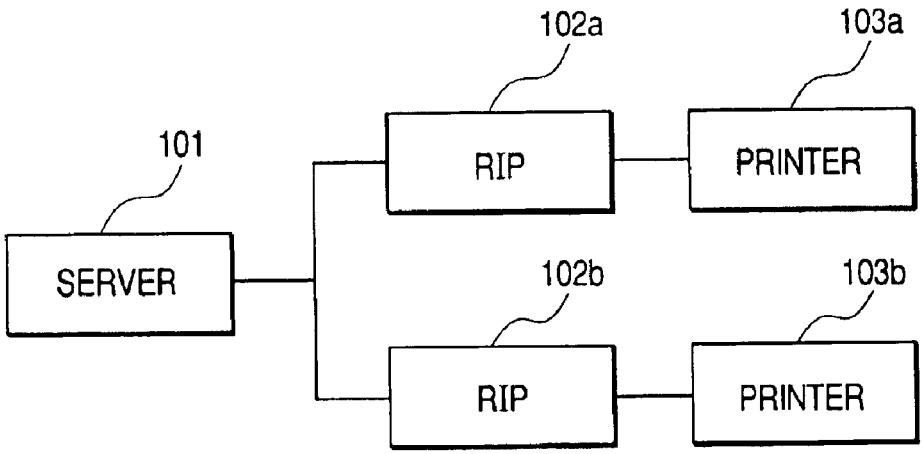
FIG. 20 is a diagram showing a cluster printing system.
Figure 21A:
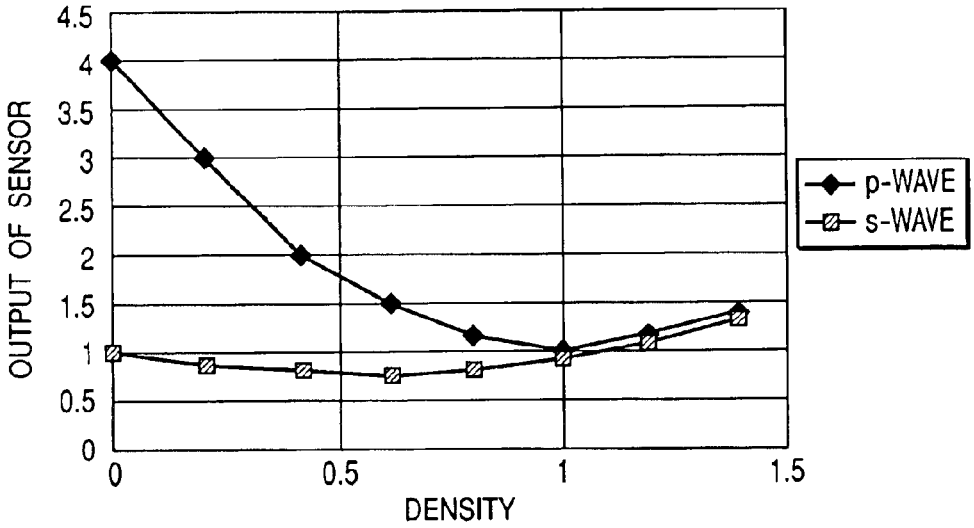
FIG. 21A is a graph showing outputs of a p-wave and an s-wave in density detecting means.
Figure 21B:
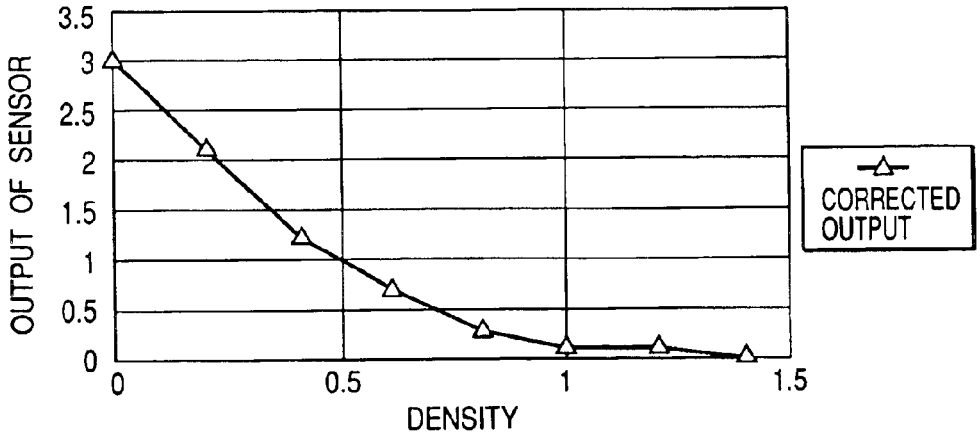
FIG. 21B is a graph showing corrected outputs.

In this embodiment, the present invention is applied to a cluster printing system for unitarily managing a plurality of printers and controlling outputs. The same parts as those in the first embodiment will be omitted in the following descriptions. FIG. 20 shows a structure of the cluster printing system in accordance with this embodiment. The cluster printing system is constituted of a server 101, RIPs 102*a* and 102*b* connected to the server 101 and printers 103*a* and 103*b* connected to the RIPs 102*a* and 102*b*, respectively.

In the cluster printing system, distributed processing is performed in order to improve productivity of the system as a whole, for example, for an output file consisting of 100 pages. In this case, 50 pages are outputted by the printer 103*a* and 50 pages are outputted by the printer 103*b*. At this time, if hue or tone is different between the two printers, the cluster printing system is not considered high in quality. Thus, density detection sensors are mounted on the printers 103*a* and 103*b*, respectively, and the same correction coefficient optimization process as in the first embodiment is provided. Consequently, densities of the two different printers can be matched with high accuracy and a high quality cluster printing system can be provided.

Further, in this embodiment, if a common reference plate is used for a plurality of printers and read instead of reading a background by respective printers, density control with higher accuracy can be performed.

It is needless to mention that this embodiment can also be attained by supplying a storage medium having stored therein a program code of software for realizing the functions of the above-described each embodiment to an image forming apparatus, and by a CPU of a control portion of the image forming apparatus reading out and executing the program code stored in the storage medium. In this case, the program code itself read out from the storage medium realizes a new function of the present invention, and the storage medium having the program code stored therein constitutes the present invention.

As described above, according to the above-described each embodiments, it becomes possible to detect a toner density with high accuracy regardless of individual differences or attachment accuracy of sensors. That is, control of image forming conditions can be optimized.

What is claimed is:

1. A correction method of a control mechanism which includes image forming means for forming a toner image, a light emitting element for emitting light toward a predetermined toner image formed by the image forming means, a first light receiving element for receiving regular reflection light caused by a light emission of the light emitting element, and a second light receiving element for receiving diffuse reflection light caused by the light emission of the light emitting element, the control mechanism controls an image forming condition of the image forming means on the basis of a corrected output obtained from an output of the first and second light receiving elements, said correction method comprising the steps of:

forming a toner image for correction by the image forming means;

detecting, by the first and second light receiving elements, diffuse reflection light caused when the light emitting element emits light toward the toner image for correction; and correcting the corrected output on the basis of outputs of the first and second light receiving elements obtained in said detecting step.

2. A correction method according to claim 1, wherein the control mechanism controls the image forming condition of the image forming means on the basis of $A-k\times B$, wherein A is the output of the first light receiving element, B is the output of the second light receiving element, and k is a coefficient, and wherein the coefficient k is corrected in said correcting step.

3. A correction method according to claim 1 or 2, wherein said forming step includes forming the toner image for correction having a higher density than a normal toner image.

4. An image forming apparatus comprising:

image forming means for forming a toner image;

a light emitting element for emitting light toward a predetermined toner image formed by said image forming means;

a first light receiving element for receiving regular reflection light caused by a light emission of said light emitting element;

a second light receiving element for receiving diffuse reflection light caused by the light emission of said light emitting element;

control means for controlling an image forming condition of said image forming means on the basis of a corrected output obtained from outputs of said first and second light receiving elements; and correction means for correcting the corrected output on the basis of a detection result of said first and second light receiving elements receiving diffuse reflection light caused when said light emitting element emits light toward a toner image for correction formed by said image forming means.

5. An image forming apparatus according to claim 4, wherein said control means controls the image forming condition of said image forming means on the basis of $A-k\times B$, wherein A is output of said first light receiving element, B is output of said second light receiving element, and k is a coefficient, and wherein said correction means corrects coefficient k.

6. An image forming apparatus according to claim 4 or 5, wherein said image forming means forms the toner image for correction having a higher density than a normal toner image.

* * * * *